United States Patent [19]

Schedele et al.

[11] Patent Number: 4,577,172

[45] Date of Patent: Mar. 18, 1986

[54] ELECTROMAGNETIC RELAY AND METHOD FOR THE MANUFACTURE THEREOF

[75] Inventors: Helmut Schedele, Diessen; Josef Schweiger, Munich, both of Fed. Rep. of Germany

[73] Assignee: Siemens Aktiengesellschaft, Berlin & Munich, Fed. Rep. of Germany

[21] Appl. No.: 659,893

[22] Filed: Oct. 11, 1984

[30] Foreign Application Priority Data

Oct. 20, 1983 [DE] Fed. Rep. of Germany ..... 3338198

[51] Int. Cl.[4] ..... H01H 51/22

[52] U.S. Cl. ..... 335/80; 335/81; 29/602 R

[58] Field of Search ..... 335/78, 80, 81, 229, 335/230, 235; 29/602

[56] References Cited

U.S. PATENT DOCUMENTS

| | | | |
|---|---|---|---|
| 3,670,281 | 6/1972 | Rattan | 337/112 |
| 4,091,346 | 5/1978 | Nishimura et al. | 335/78 |
| 4,182,998 | 1/1980 | Mueller et al. | 335/151 |
| 4,195,276 | 3/1980 | Rauterberg | 335/151 |
| 4,311,976 | 1/1982 | Sauer et al. | 335/78 |
| 4,368,574 | 1/1983 | Litt et al. | 29/602 |
| 4,403,203 | 9/1983 | Schedele | 335/81 X |

FOREIGN PATENT DOCUMENTS 2647203 4/1978 Fed. Rep. of Germany .

*Primary Examiner*—George Harris

*Attorney, Agent, or Firm*—Hill, Van Santen, Steadman & Simpson

[57] ABSTRACT

A relay formed of a coil body as a base body with a central opening passing therethrough and having an armature or contact tongue element positioned in said opening in an axial direction. One end of the tongue element is fastened and has fastening tabs at both sides of a central tongue. The fastening elements are fixed by means of a hardened glue in relatively broad grooves of a flange of the base body. During assembly, the contact tongue can be brought into a defined position by mechanical, magnetic or pneumatic means and can be fixed in this final position by means of introducing a fast-setting glue into the grooves so that subsequent adjustment is no longer necessary.

19 Claims, 5 Drawing Figures

ELECTROMAGNETIC RELAY AND METHOD FOR THE MANUFACTURE THEREOF

BACKGROUND OF THE INVENTION

The invention relates to an electromagnetic relay comprising a coil body serving as a base body and comprising an armature or contact tongue disposed in an axial cavity of the base body. A fastening end of the contact or armature tongue is secured in grooves of a first coil flange via lateral fastening tabs, and the free end thereof is switchable between pole plates or cooperating contact elements in the region of a second coil flange. The invention also relates to a method for the manufacture of such a relay.

A relay of the type indicated above is known, for example, from DE-OS No. 26 25 203, corresponding to U.S. Pat. No. 4,091,346, incorporated herein by reference. The armature tongue therein has its fastening end pressed into grooves of a coil flange and is thus secured in a press fit manner. Due to the unavoidable manufacturing tolerances at the piece parts, however, adjustment after assembly is necessary, this being possible given the relay of DE-OS No. 26 25 203 only by means of bending the firmly mounted contact tongue with a mechanically acting bending tool.

A similarly constructed relay is known from DE-AS No. 26 47 203, incorporated herein by reference, wherein the contact tongue has its fastening end welded to a terminal pin that is torsionally secured in a guidance portion of the coil body flange. The contact tongue receives the desired setting or pre-stress relative to the cooperating contact elements during assembly by means of a corresponding setting of the welding electrodes. This relay, however, requires extremely exact work and a precise setting of the welding apparatus. It is very difficult given extremely small relays to perform an operation on the relay with welding electrodes.

SUMMARY OF THE INVENTION

An object of the invention is to create a relay of the type initially cited which is constructed with a few simple parts and which can be aligned so precisely during fabrication that a subsequent adjustment is no longer required. A method for the manufacture of this relay shall also be specified, whereby the relay can already be adjusted during assembly and without an additional work step, and whereby, in particular, a contact-free adjustment is possible.

The object is achieved since the thickness of the fastening tabs is significantly less than the grooves in the first coil which accepts them, and since the fastening tabs are fixed by means of a hardened or cured glue that fills out the remaining space in the grooves.

In the inventive relay, the contact or armature tongue in fact has its fastening end plugged into grooves of the coil body flange, but is not ultimately fixed by means of embedding or by means of press fit directly with the contours of the coil body. Since the fastening tabs have play in the grooves of the coil body and are not finally fixed until the glue has been introduced during assembly, there is a possibility of placing the armature or contact tongue into the desired position during introduction and curing of the glue and briefly holding it in this position until the glue has hardened.

The armature or contact tongue preferably comprises a respective region cut free at both sides between the actual tongue and the fastening tabs at both sides, said armature or contact tongue resting against defined guide webs of the coil body within said regions. In an advantageous embodiment, the fastening end of the armature or contact tongue is connected in one piece construction via retaining webs to the fastening tabs and to a flux transfer plate lying perpendicular to the longitudinal extent of the tongue. A connection barb can also be directly applied to the flux transfer plate.

The flux transfer plate preferably lies in a depression of the coil flange so that the relay can be sealed by means of applying a film to the flux transfer plate and to adjacent regions of the coil flange. The armature or contact tongue itself has its fastening end provided with a recess between the fastening tabs or the retaining webs, so that the free mobility of the tongue during switching is also guaranteed given the application of the sealing film. It is also preferable that the grooves in the coil body which accept the fastening tabs open toward the outside into an expanded chamber into which a casting compound sealing the entire relay housing can extend, so that this part of the fastening tabs situated in these chambers is additionally fixed.

A method is disclosed herein for the manufacture of a relay comprising a base body as well as comprising an armature or contact tongue extending lengthwise in a cavity of the base body, the fastening end of the contact or armature tongue being secured in grooves of the base body by means of laterally applied fastening tabs. Its free end is directed to at least one pole plate or cooperating contact element. A method is also disclosed for the manufacture of a relay of the type initially cited. According to the invention, the grooves in the base body are designed wider than the thickness of the fastening tabs. The armature or contact tongue is first loosely plugged into the grooves with its fastening tabs. The free end of the armature or contact tongue is brought into a defined position relative to the pole or pole plates or cooperating contact element or elements and is held in this position while a glue is filled into the grooves and caused to harden or cure. The armature or contact tongue preferably has its free end held in a central position between two pole plates and is fixed in this position. The adjustment of the armature or contact tongue into this central position or into a desired, single-sided seating against one of the pole plates or cooperating contact elements can occur, for example, with mechanical or magnetic auxiliaries.

Particularly advantageous, however, is a method wherein the armature or contact tongue is brought into the defined position by means of an air stream generated in the cavity of the base body and is held in this position until the glue has hardened. This air stream can be generated by means of a blower device directed at the fastening end of the armature or contact tongue. Even more advantageous, however, is the production of the air stream by means of a suction device disposed in front of the free end of the armature or contact tongue, since the introduction of the glue at the fastening end is easier in this case.

DESCRIPTION OF THE PREFERRED EMBODIMENTS

Figure 1:
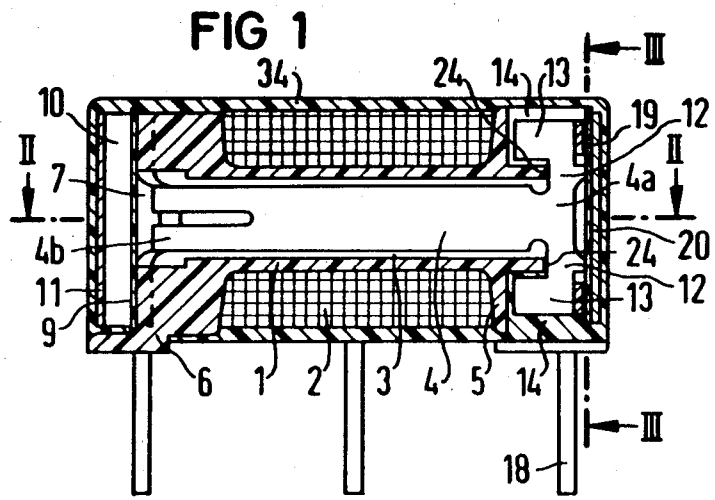
FIGS. 1 through 3 show a relay according to the invention in three different sectional views.
Figure 2:
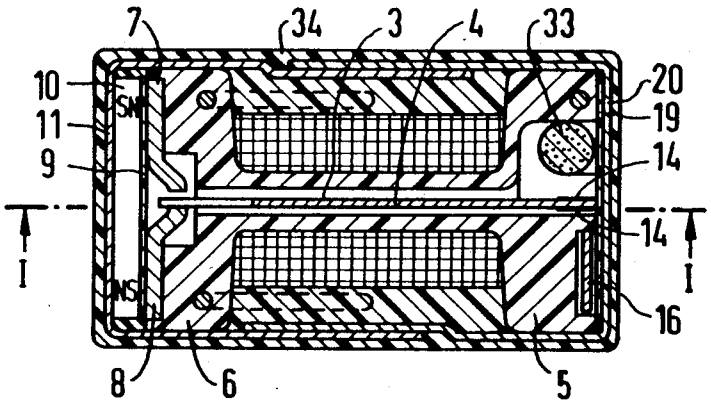
Figure 3:
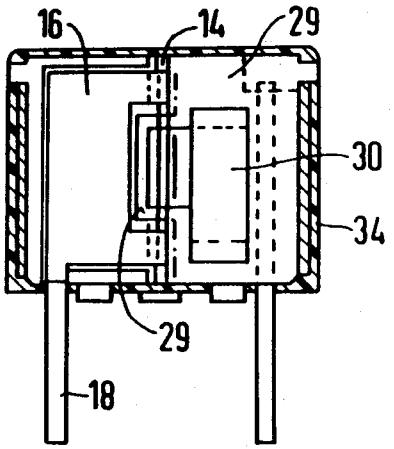

As a base body, the relay illustrated in FIGS. 1 through 3 comprises a coil body 1 with a winding 2. The coil body has a through opening 3 in the axial direction. A ferromagnetic armature and contact tongue 4 is disposed in the axial direction in this opening, the fastening end 4*a* thereof being anchored in a coil flange 5. Its free end, which is split in fork-like fashion for double contacting, is switchable between two pole plates 7 and 8 in the region of the other coil flange 6.

A four-pole permanent magnet 10 is coupled to the pole plates 7 and 8 upon interposition of an insulating and sealing film 9. This permanent magnet 10 has two oppositely parallel polarization directions such that unlike poles are adjacent to the two pole plates and the respectively opposite poles are coupled to an externally situated flux guide plate 11.

At its fastening end 4*a*, the armature and contact tongue 4 comprises respective fastening tabs 13 at both sides applied via fastening webs 12. The fastening tabs 13 lie in one plane with the actual tongue segment and are secured in grooves 14 of the coil body flange 5. A flux transfer plate 16 is applied in one piece fashion to the contact tongue 4 at right angles thereto via the fastening tabs 13 and via retaining webs 15. The flux transfer plate lies in a flat recess 17 of the coil flange 5 and forms a connection finger 18 toward the bottom (see FIG. 4 as well). A U-shaped flux guidance plate 20 is attached upon interposition of an insulation and sealing film 19. As a result of a mutually pivoted arrangement, the two flux guidance plates 11 and 20 overlap and thus form a frame-like yoke for the permanent magnetic circuit as well as for the control circuit of the relay.

Figure 4:
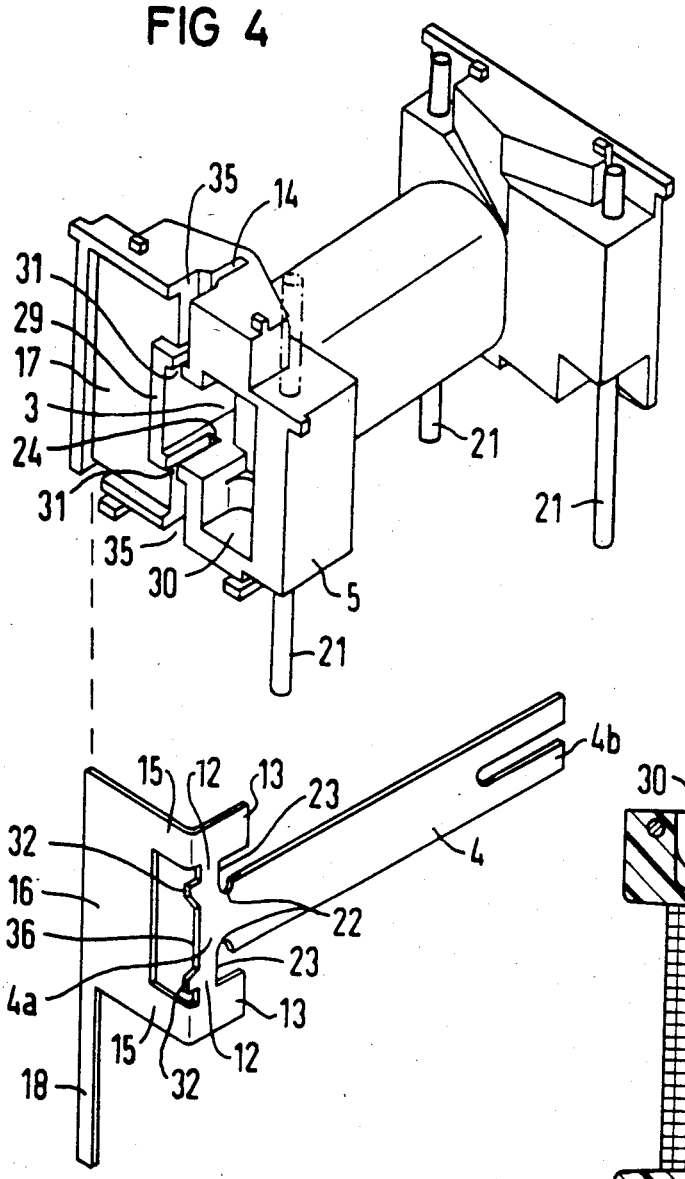
FIG. 4 is a coil body with an armature or contact tongue in a perspective view.

The assembly and adjustment of the relay will now be explained in greater detail with reference to FIGS. 4 and 5. The coil body 1 shown in FIG. 4, which is already provided with injected terminal pins 21, is first provided with the winding (not shown in FIG. 4) and the contact tongue 4 is then introduced into the through coil body opening 3 from one side (from the left in FIG. 4). At its fastening end 4*a*, the contact tongue 4 is cut free in the region of the fastening webs 12 and is reduced in cross-section by means of recesses 22, so that it is decoupled from its clamping location and receives a soft spring characteristic. After being plugged in, the fastening tabs 13 lie loosely and with play in the grooves 14 of the coil body flange, since the grooves are wider than the material thickness of the fastening tabs 13. The two cut-free edges 23 of the contact tongue 4 respectively lie against seating surfaces 24 of the coil body flange so that a pivot axis arises around which the armature or contact tongue 4 and the fastening tabs 13 as well are pivotable and freely movable. It need not be a matter of a bearing notch or of a bearing edge. On the contrary, the edges 23 of the contact tongue 4 can also slide against the seating surfaces 24 in order to align precisely in the center of the coil body opening 3.

Figure 5:
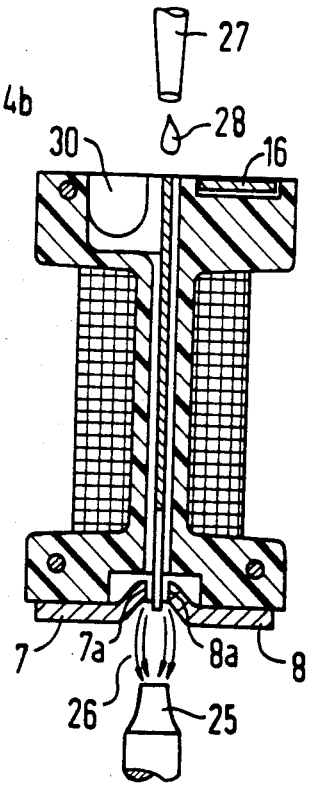
FIG. 5 is a schematic illustration of a method of fastening the contact tongue in the coil body.

FIG. 5 shows the adjustment and fastening operation. An air stream 26 is thus generated through the coil body opening 3 along the plugged-in contact tongue 4 by means of a suction nozzle disposed in front of its free end 4*b*, the air stream 26 precisely aligning the contact tongue 4. When the suction nozzle 25 is disposed precisely in the center between the pole faces 7*a* and 8*a* of the two pole plates 7 and 8, then the free end of the contact tongue is likewise aligned exactly in the center. When the suction nozzle is displaced toward one side, then the air stream also becomes asymmetrical and the contact tongue is aligned toward one of the two pole plates.

While the air stream 26 acts on the contact tongue 4 and holds it in the desired adjustment, a specific amount of fast-setting glue 28 is introduced into the grooves 14 at the fastening end by means of a dosing apparatus 27, said glue filling out the free space between the fastening tabs 13 and the side walls of the grooves 14 by means of capillary action. This fixes the contact tongue 4 in the adjusted position after hardening in a few seconds. During this adjustment and fastening of the contact tongue, the coil body is preferably held in the vertical arrangement shown in FIG. 5 so that the contact tongue hangs down. It is thus guaranteed that the contact tongue aligns both in the direction of its own pivot axis as well as in the axis perpendicular thereto under the influence of the air stream by means of a sliding motion against the seating surfaces 24. The introduction of the glue is also facilitated given this attitude of the coil body.

In addition to the recess 17, the coil body flange 5 also has a bead 29 corresponding to the thickness of the flux transfer plate 16. The bead or projection 29 surrounds the coil body opening 3 as well as a getter chamber 30 which communicates therewith. The fastening webs 12 of the contact tongue 4 are plugged by means of two slots 29 in this bead 31. They are plugged in such that the projecting noses 32 of the contact tongue 4 terminate flush with the surface of the bead 29. After the above-described adjustment and fastening of the contact tongue, a getter 33 is introduced into the getter chamber 30 and the aforementioned insulation and sealing film 19 is then glued onto the planar surface formed by the flux transfer plate 16 and the bead 29 together with the noses 32. After the application of the film 19 and of the permanent magnet 10 to the opposite side, and after the flux guidance plates 11 and 20 have been put in place, the relay is cast out in a form or is embedded in an insulating casting compound so that an additional protective cap can be omitted. For the purpose of additional securing and fastening of the contact tongue 4, the coil body flange also comprises respectively expanded chambers 35 following upon the grooves 14, the casting compound flowing into the chambers and thus fixing those sections of the fastening tabs 13 located in these chambers. As a result of capillary action, the casting compound can also penetrate into the slots 31 next to the fastening webs 12; then, however, it can penetrate no further into the interior or the opening 3 of the coil body, since the capillary action ceases at the edge of the slots 31. Between the two noses 32, the contact tongue also has a recess 36 which ensures the contact tongue does not strike against the film 19 in this region and thus remains freely movable.

Although various minor changes and modifications might be proposed by those skilled in the art, it will be understood that we wish to include within the claims of the patent warranted hereon all such changes and modifications as reasonably come within our contribution to the art.

We claim as our invention:

1. An electromagnetic relay, comprising:

a coil body serving as a base body;

an armature or contact tongue element secured at one end and being aligned in an axial cavity of said base body;

the secured end of the tongue element being secured in grooves of a first coil flange of the base body via lateral fastening tabs, and an opposite free end of the element being movable adjacent to a pole plate or cooperating contact element in a region of a second coil flange of the base body;

a thickness of said fastening tabs being significantly less than a width of said grooves in said first coil flange which accepts the fastening tabs; and said fastening tabs being fixed by means of a hardened glue which fills in a space in said grooves.

2. A relay according to claim 1 wherein said tongue element comprises fastening webs formed by cut-out portions at both sides of a central tongue and joining to said fastening tabs at both sides, said tongue element resting against seating surfaces of said coil body at edges of said fastening webs.

3. A relay according to claim 1 wherein the secured end of said tongue element is of one-piece construction and comprises a central tongue, retaining webs, and a flux transfer plate, said retaining webs and flux transfer plate being at right angles to a longitudinal extent of said central tongue.

4. A relay according to claim 3 wherein a connection finger is provided on said flux transfer plate.

5. A relay according to claim 3 wherein said flux transfer plate lies in a depression of the coil flange.

6. A relay according to claim 1 wherein said grooves in said first coil flange open into respective expanded chambers into which a casting compound sealing the overall relay extends and additionally fixes that part of said fastening tabs situated in said chamber.

7. An electro-magnetic relay, comprising:

a coil body having a central aperture passing longitudinally therethrough;

an armature or contact tongue element aligned within the aperture and being secured at one end to support means attached to the coil body;

said tongue element comprising a central tongue and first and second fastening tabs laterally of the central tongue and being connected to the central tongue by fastening web means which permit flexing of the tongue relative to the fastening tabs;

first and second grooves for receiving said fastening tabs, said grooves being wider than the fastening tabs so as to permit lateral movement of the fastening tabs within the grooves; and the fastening tabs being attached in the grooves by glue.

8. A relay according to claim 7 wherein first and second abutment surfaces are provided which abut against edges of the tongue element prior to securing the same with said groove so as to permit alignment of the central tongue within the aperture of the coil body.

9. A relay according to claim 8 wherein said abutment surfaces are provided between said fastening tabs and central tongue and which provide an edge contact to permit rocking of the tongue element prior to gluing.

10. A relay according to claim 1 wherein two pole plates or cooperating contact elements are provided and the tongue element is glued in position such that the free end of the central tongue is spaced equidistant between the two elements.

11. A method for the manufacture of a relay comprising a base body, an armature or contact tongue element which extends lengthwise in a cavity of said base body, a fastening end of said tongue element having fastening tabs to be secured in grooves of said base body, a free end thereof being aligned relative to at least one pole plate or cooperating contact element, comprising the steps of:

providing grooves in said base body which are wider than a thickness of said fastening tabs;

positioning said tongue element within said cavity by loosely plugging said tongue element fastening tabs into said grooves;

bringing the free end of said tongue element to a defined position relative to said pole plate or contact element; and holding it in this position while a glue is introduced into said grooves and also as it is hardened.

12. A method according to claim 11 wherein said tongue element is held in a central position between two pole plate or contact elements and is fixed in this position.

13. A method according to claim 11 including the step of bringing said tongue element into said defined position by means of an air stream generated in said cavity of said base body and holding it in said position until said glue has hardened.

14. A method according to claim 13 including the step of generating said air stream by a suction device disposed in front of the free end of said tongue element.

15. A method according to claim 13 including the step of generating said air stream by means of a blower device directed at the fastening end of said tongue element.

16. A method according to claim 11 including the step of bringing said tongue element into said defined position by magnetic means and holding it in this position until said glue has hardened.

17. A method according to claim 11 including the step of bringing said tongue element into said defined position by mechanical means and holding it in this position until said glue has hardened.

18. A method for manufacturing a relay formed of a coil body having a central aperture therein and wherein an armature or contact tongue element which is to be secured at one end, which is flexible, and which has its other end unattached, and wherein the free end is to be at a predetermined spacing from a pole plate or contact element, comprising the steps of:

providing the tongue element with a fastening tab and providing a cooperating groove having a width greater than a thickness of the fastening tab in the coil body at the end where the tongue element is to be secured;

inserting the tongue element into the central aperture and plugging the tab into the groove; and positioning the free end of the tongue element at said defined spacing and gluing the tab in the groove so as to fix the same in position.

19. A method according to claim 18 wherein an air stream is directed through the central aperture which aligns the free end at said predetermined spacing and then gluing the fastening tab in the groove.

* * * * *